United States Patent [19]

Shinohara et al.

[11] Patent Number: 4,487,245

[45] Date of Patent: Dec. 11, 1984

[54] TORQUE-ADJUSTING DEVICE FOR USE IN A ROLLER BLIND

[75] Inventors: Kazuo Shinohara; Yoshihiro Shoji, both of Tokyo, Japan

[73] Assignee: Toso Kabushiki Kaisha, Tokyo, Japan

[21] Appl. No.: 291,949

[22] Filed: Aug. 11, 1981

[30] Foreign Application Priority Data

Aug. 29, 1980 [JP] Japan ..... 55-121907[U]

[51] Int. Cl.[3] ..... A47G 5/02

[52] U.S. Cl. ..... 160/313

[58] Field of Search ..... 160/1, 170, 291–294, 160/296–299, 301, 305, 313–318, 323–326

[56] References Cited

U.S. PATENT DOCUMENTS

| | | | |
|---|---|---|---|
| 2,737,235 | 3/1956 | Hediger | 160/170 |
| 3,260,302 | 7/1966 | Griesser | 160/170 |
| 3,665,996 | 5/1972 | Roberts | 160/1 |
| 4,112,996 | 9/1978 | Fohl | 160/296 |
| 4,345,636 | 8/1982 | Fukuchi | 160/297 |

*Primary Examiner*—Peter M. Caun

*Attorney, Agent, or Firm*—Birch, Stewart, Kolasch & Birch

[57] ABSTRACT

A torque-adjusting device for twisting and untwisting a spring-motor built in a roller assembly is equipped with an easily operatable handle ring. The device includes a brake drum secured to a mounting bracket, a coil spring fitted on the brake drum, an intermediate disk disposed between the coil spring and the handle ring. The intermediate disk is integrally coupled with a stator to which one end of the spring-motor is fixed. The handle ring has an inner tongue inserted between the opposite projecting ends of the coil spring in a slit in the periphery of the disk with the result that the coil spring permits a rotational transmission from the handle ring to the stator but suppresses the counter transmission.

4 Claims, 3 Drawing Figures

TORQUE-ADJUSTING DEVICE FOR USE IN A ROLLER BLIND

BACKGROUND OF THE INVENTION

This invention relates to a torque-adjusting device for use in a roller blind of the type having a built-in spring-motor to roll up a screen.

A roller blind has a roller assembly supported by a pair of mounting brackets and provided with a hollow roller on which a screen is wound. A spring-motor is contained in the hollow roller and has one end thereof secured to a stator and the other end fixed to a rotator which is integrally secured to the hollow roller. In general, the stator is preliminarily wound before the roller assembly is mounted in the brackets to give an initial torque to the spring-motor for the purpose of surely rolling up the screen drawn down. The initial torque is desirably adjusted to such a value in which the screen is lightly pulled down by one's hand and smoothly rolled up by the spring-motor. The optimum value can not be decided without several trials of adjustment, because it depends upon many factors, for example, the machanical property of the screen as well as the spring-motor. The trial is made to give the optimum torque to the spring-motor as follows: The stator is gradually rotated in one direction to increase the torque in the spring-motor if the screen is weakly taken up but inversely rotated little by little if it is somewhat heavy to be pulled down by one's hand.

The known device comprises the stator directly mounted in the mounting bracket. This leads to a disadvantage that the spring-motor can not have the initial torque thereof adjusted unless the roller assembly is removed from the mounting brackets. It is very troublesome to put off the roller assembly from the permanent position and reset the same in the original position several times for torque-adjustment until the spring-motor has the optimum initial torque.

It is the primary object of the invention to provide a torque-adjusting device for use in a roller blind of the type having a built-in spring-motor, in which the initial torque in the spring-motor is easily adjusted while the roller assembly is set up in the permanent position.

SUMMARY OF THE INVENTION

To this end, a torque-adjusting device in accordance with an embodiment of the invention includes a hollow brake drum secured to a mounting bracket, a brake coil spring fitted on the brake drum, an intermediate disk fitted on the brake coil spring and coupled with the stator for rotation therewith, the brake coil spring having the oppposite ends thereof inserted into a slit in the intermediate disk, a handle ring fitted on the intermediate disk and formed with an inner radial tongue inserted between the opposite ends in the slit. The intermediate disk has on one side thereof an axis rotatably inserted into the hollow brake drum and coupled with the same by a screw and a washer and on the other side an angular projection closely fitted in an angular recess in the stator. The handle ring has the outer periphery thereof saw-shaped and somewhat protruded from the semicircular arm of the mounting bracket. The stator is rotatably mounted in the rotator with the intervention of a ball bearing.

The advantages offered by the invention are mainly that the roller assembly is not needed to be dismounted from the set-up position for adjustment of torque in the spring-motor. The torque-adjusting device is compactly interposed between the mounting bracket and one end of the roller assembly to brake either transmission from the spring-motor to the stator. The handle ring in the device is easily operated by one's finger tip to twist and untwist the spring-motor.

BRIEF DESCRIPTION OF THE DRAWINGS

One way of carrying out the invention is described in detail below with reference to drawings which illustrate only one specific embodiment, in which.

DETAILED DESCRIPTION

Figures 1, 2, 3:
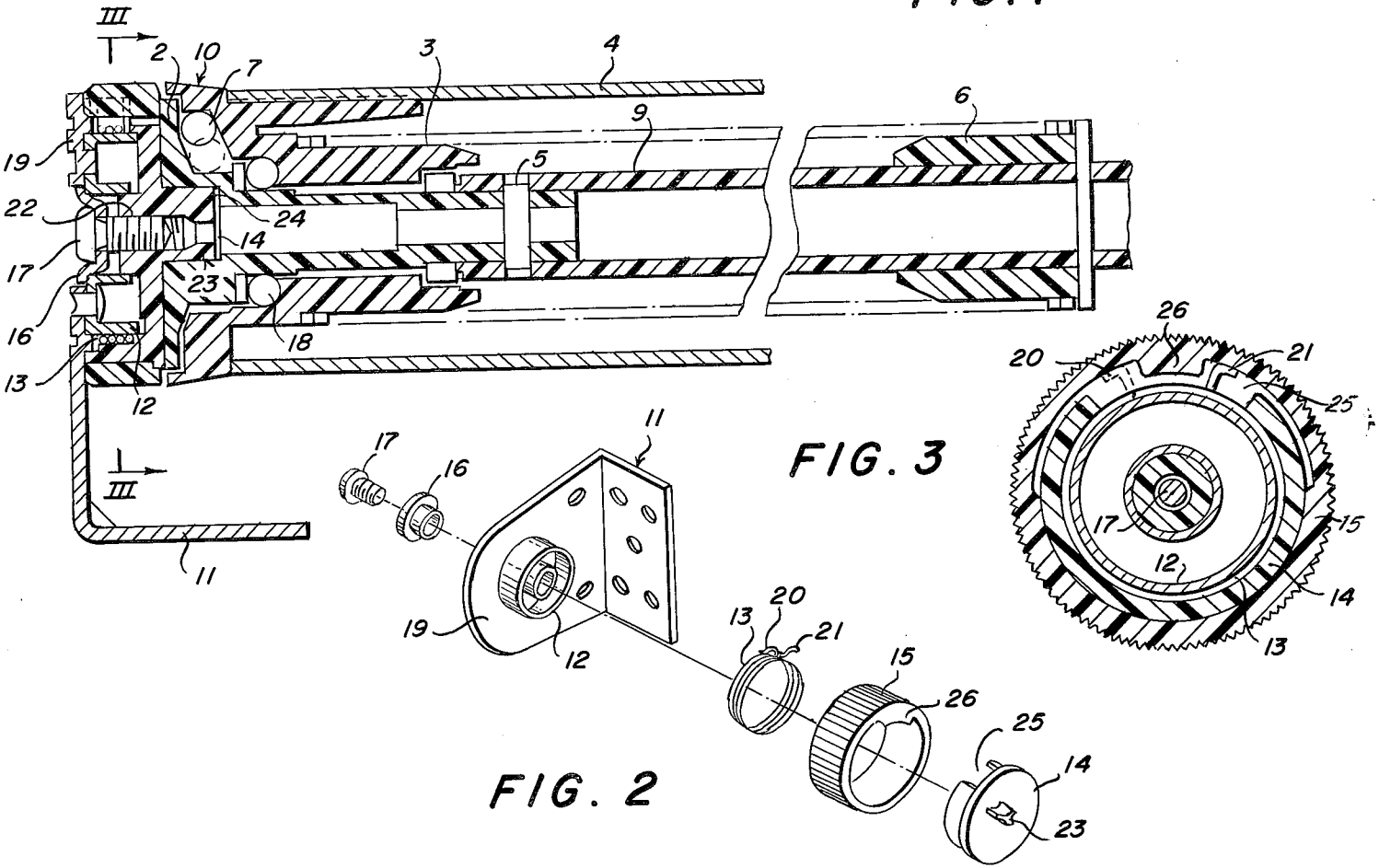
FIG. 1 is a sectional view of the relevant portion of a roller blind provided with the torque-adjusting device of the invention.
FIG. 2 is a perspective view of the exploded parts of the device of FIG. 1.
FIG. 3 is a sectional view along the line III-III of FIG. 1.

FIGS. 1 to 3 show a torque-adjusting device for use in a roller blind 1, in which a roller assembly 10 has a stator 2, a rotator 3 rotatably fitted in the stator 2 through the intermediary of a ball bearing 18, and a hollow roller 8. The stator 2 and the rotator 3 are coupled with each other with the intervention of balls 7 to form a braking mechanism by which the rotator 3 is freely rotatable about the stator 2 when the ball 7 is out of the braking groove in the stator 2 but integrally fixed to the stator 2 when the ball falls into the braking groove in the stator 2. The ball 7 comes out of the groove in the stator 2 while the stator 2 rotates in the direction in which the screen is rolled up but is always in the groove while the stator 2 rotates in the direction in which the screen is drawn down. A spring-motor 4 is contained within the hollow roller 8 and has one end thereof secured to a ring 6 which is fixedly mounted on a tube 9 directly joined to the stator 2 by a pin 5, having the other end fixed to the rotator 3, which is removably fixed to the hollow roller 8 on which a non-illustrated screen is wound.

A mounting bracket 11 has an arm portion 19 to which a hollow brake drum 12 is secured. A brake coil spring 13 is mounted on the brake drum 12 and has the opposite ends 20, 21 thereof radially outwardly projecting. An intermediate disk 14 has on one side thereof an outer circular projection 22 rotatably fitted in the center bore in the brake drum 12 and on the other side an angular projection 23 closely fitted in an angular recess 24 in the stator 2. The disk 14 is connected to the arm portion 19 of the mounting bracket 11 through the intermediary of a screw 17 with a washer 16. The disk 14 has an outer periphery loosely fitted on the coil spring 13 and formed with a slit 25 into which the opposite ends 20, 21 are inserted. A handle ring 15 is mounted on the disk 14 and formed with an radial inner tongue 26 fitted between the opposite ends 20, 21 of the brake coil spring 13 in the slit 25, as best seen in FIG. 3. As the handle ring 15 turns, the tongue 26 pushes either of the both ends 20, 21 so as to cause the brake coil spring 13 to loosen and rotate together with the handle ring 15 and, then while abutting against the disk 14 to rotate the same together with the stator 2. As the handle ring 15 turns in the direction in which the screen is wound up, the stator 2 rotates relative to the rotator 3 to twist the spring-motor 4. On the other hand, as the handle ring 15 rotates in the counter direction in which the screen is drawn off, the stator 2 turns integrally with the rotator 3, therefore the spring-motor is untwisted to roll up by the extent of torque necessary for rolling up the length of the screen which is drawn off. Thus, the spring-motor 4 is twisted or untwisted in accordance with the rotary direction of the handle ring 15. The handle ring 15 is thin and somewhat protruded from the semicircular arm portion 19 of the bracket 11 so as to be easily operated by one's finger tip. However, it is substantially impossible for the spring-motor 4 to rotate the stator 2, because the coil spring 13 is tightened and fixed to the brake drum 12 through the intermediary of a screw 17 with a washer 16 to suppress the rotation of the disk 14 immediately after the spring-motor 4 moves the disk 14 as well as the stator 2 and causes the edge of the slit 25 to push either of the both ends 20, 21. Then, the handle ring 15 rotates the stator 2 both in a direction in which the brake coil spring 13 is tightened and in the other direction in which the brake coil spring 13 is loosened with the intervention of the stator 2, but the spring-motor 4 cannot rotate the handle ring 15 with the intervention of the stator 2.

The initial torque of the spring-motor 4 is adjusted after the roller assembly 10 is set up at the permanent position in the mounting brackets 11. At first, the screen is manually operated to test the preliminarily given torque. If the screen is somewhat strong to be pulled down and violent to roll up, the handle ring 15 is turned a little in the direction in which the screen is drawn. Thus, the spring-motor 4 has the initial torque reduced by the torsion necessary for rolling up the drawn length of the screen. On the other hand, if the screen is feeble to wind up, the handle ring 15 is inversely rotated with the result that the spring-motor 4 is twisted to increase the initial torque. The handle ring 15 has the outer periphery thereof saw-shaped and somewhat protruded from the semicircular arm portion 19 of the bracket 11 so as to be easily turned by one's finger tip. Each trial of adjustment is quickly performed without requiring removal of the roller assembly 10 from the mounting bracket 11. After a few trials have been completed, the spring-motor 4 has the optimum torque by which the screen is lightly pulled down and smoothly rolled up. The optimum torque, once adjusted, is stable, because the coil spring 13 prevents the handle ring 15 from being rotated by the spring-motor 4.

What is claimed is:

1. A torque-adjusting device for use in a roller blind provided with a spring-motor having one end thereof secured to an elongated end of a stator and the other end fixed to a rotator integral with a hollow roller on which a screen is wound, said device comprising:

a hollow brake drum adapted to be secured to a mounting bracket;

a brake coil spring operatively fitted on said brake drum and including opposite ends;

an intermediate disk fitted on said brake coil spring and operatively coupled with said stator for rotation therewith;

a slit positioned in an outer periphery of said intermediate disk;

said brake coil spring having the opposite ends thereof projecting radially outwardly and inserted into the slit in the outer periphery of said intermediate disk; and a handle ring operatively fitted on said intermediate disk and formed with an inner radial tongue inserted between the opposite ends of said slit;

whereby said brake coil spring permits said stator to be selectively rotated by said handle ring for adjustment of the torque of said spring-motor but prevents said stator from being rotated by said spring-motor.

2. A device as claimed in claim 1, wherein said intermediate disk has on one side thereof an outer circular projection rotatably inserted into and coupled with said hollow brake drum through the intermediary of a screw and a washer and on the other side an angular projection closely fitted in an angular recess in said stator.

3. A device as claimed in claim 1, wherein said handle ring has the outer periphery thereof saw-shaped and somewhat protruded from the semicircular arm portion of said bracket.

4. A device as claimed in claim 1, wherein said stator is rotatably fitted in said rotator with the intervention of a ball bearing.

* * * * *